United States Patent [19]

Beasley

[11] Patent Number: 4,768,774

[45] Date of Patent: Sep. 6, 1988

[54] AQUATIC EXERCISE DEVICE

[76] Inventor: Bob L. Beasley, 1217 Terra Mar Dr., Tampa, Fla. 33613

[21] Appl. No.: 839,038

[22] Filed: Mar. 12, 1986

[51] Int. Cl.[4] ..... A63G 31/00; A63B 31/00; A63C 15/03; A63H 23/10

[52] U.S. Cl. ..... 272/1 B; 272/71; 441/78; 446/153

[58] Field of Search ..... 441/88, 132, 90, 123, 441/136; D21/236, 237; 272/1 B, 116, 71

[56] References Cited

U.S. PATENT DOCUMENTS

| | | | |
|---|---|---|---|
| 20,598 | 11/1881 | Gann | 441/88 |
| 1,487,923 | 7/1923 | Vilbiss | 441/123 |
| 2,540,823 | 8/1984 | Laurens | 441/136 |
| 2,718,644 | 11/1952 | Barr | 272/1 B |
| 2,962,283 | 10/1959 | Casey | 272/1 B |
| 3,203,694 | 8/1965 | Kobashikawa | 272/1 B |
| 3,379,437 | 4/1968 | Warner | 272/1 B |
| 3,517,930 | 2/1967 | Jacobsen | 272/71 |
| 3,621,500 | 11/1971 | Senghas | 272/1 B |
| 4,336,931 | 6/1982 | van Staden | 272/1 B |
| 4,527,795 | 7/1985 | Zink | 272/71 |

*Primary Examiner*—Richard J. Johnson
*Assistant Examiner*—Michael Brown

[57] ABSTRACT

An aquatic exercise device for use in a swimming pool or the like comprising a substantially columnar-shaped, flexible buoyant body having a first and second end and partially encircles and supports the user's body and a substantially shank-type handgripping means integrally attached and projecting endwise outwardly above and below at the first and seconds ends of the substantially columnar-shaped flexible buoyant body thereby enabling the user to perform body movements in an aquatic environment similar to movements on land of walking, running, cycling, cross-country skiing, and calisthenics and further providing enhanced exercise intensity due to the aquatic resistance to movement of the user. The exercise apparatus further embraces an attachment means to grasp the first and second ends of the exercise apparatus to enable aquatic arm exercise and a fluid resistance means attached to the distal end of the hand-gripping means to increase the resistance of the exercise means upon movement in an aquatic exercise environment. The exercise apparatus further embraces an attachment means to accept a series of detachably weighed belts encircling the columnar-shaped, flexible buoyant body. The exercise apparatus further embraces an attachment means to accept a tether on the first and second end handgripping means thereof, whereby the user may secure the exercise apparatus to the body and to a fixed object along the pool side or deck during use to enable stationary exercise during use.

10 Claims, 2 Drawing Sheets

AQUATIC EXERCISE DEVICE

BACKGROUND OF THE INVENTION

1. Field of the Invention

An aquatic exercise device for use in a swimming pool or the like comprising a flexible buoyant support member partially encircling and supporting the body whereby the user performs exercise in water similar to land-based movements of walking, running, cycling, cross-country skiing, stationary swimming, and calisthenics.

2. Description of the Prior Art

Heretofore, various physical activities have been used to condition the body. Walking, running, cycling, cross-country skiing, and calisthenics have been found to be excellent land-based exercises. Swimming has also been found to be an excellent form of exercise. In addition, calisthenics and resistant exercises have been developed and used in water for conditioning the body.

Water has the advantage of offering a resistance load to strengthen and condition the body, while absorbing shock and cooling the body during exercise. Thus, the effectiveness of walking, running, cycling, cross-country skiing, and calisthenics can be greatly enhanced through performing these activities in water. In addition, stationary swimming, jogging and cycling while using a tether attached to the exerciser and a fixed object allows these activities to be performed in a relatively small swimming pool or large spa.

Various exercise devices have been designed to permit and enhance exercising in the water. However, no singular previously known device has been designed for use in performing all the above-mentioned activities and many previously designed aquatic exercise devices of a similar nature require that they be securely attached to and completely encircle the body, or body parts, of the user, such as around the chest, waist, legs, arms, or hands. These devices are described in the following publications: Runner's World magazine, May 1985; Self magazine, June 1985; Dentistry Today, July 1985; Newsweek magazine, October 1985; The Tampa Tribune, Mar. 6, 1986 and in my U.S. Pat. No. 4,509,744.

Other examples of the prior art are found in U.S. Pat. Nos. 1,062,587; 1,715,571; 3,517,930; 3,786,526; and 3,913,907.

The exercise device of the present invention is intended to be useful for the primary purpose of providing a single exercise apparatus constructed in a manner that permits performing in water a wide variety of popular land-based exercises including walking, running, cycling, cross-country skiing, stationary swimming, and calisthenics.

A further object of the invention is to provide an exercise apparatus comprising a rigid handgripping means to enable grasping and moving the first and second ends of the apparatus and to which a tether may be detachably secured during stationary exercising.

Another object of the invention is to provide an exercise apparatus constructed in a manner whereby resistance offered to movement of the first and second ends of the exercise apparatus can be increased by engagement of a fluid resistant means to the handgripping means.

Another object of the invention is to provide an exercise apparatus constructed in a manner whereby the the user may easily engage the apparatus, and quickly and freely cast off the apparatus from engagement when desired.

Still another object of the invention is to provide an exercise apparatus constructed in a manner so as to be readily usable by persons of different sizes and body densities.

A final object of this invention to be specifically enumerated herein is to provide an exercise apparatus which will conform to conventional forms of manufacture, be of simple construction and easy to use so as to provide a device that will be economically feasible, long lasting and relatively trouble free in operation.

Further objects and advantages of my invention will become apparatus from a consideration of the drawings and ensuing description thereof.

SUMMARY OF THE INVENTION

The prevent invention relates to an aquatic exercise device for use in a swimming pool or the like comprising a columnar-shaped, buoyant, flexible body; a handgripping means; a fluid resistance means and weighted belts.

The substantially columnar-shaped body comprises a first and second end and partially encircles the body.

The handgripping means comprises a substantially shank-type member integrally attached and projecting endwise outwardly above and below the first and second ends of the substantially columnar-shaped, flexible buoyant body.

The fluid resistance means comprises a substantially circular, concave rigid fluid resistance member and a substantially cylindrical rigid support shaft secured to the said fluid resistance member and detachably secured to the distal ends of the handgrips.

The weighted belts comprise substantially webb-type straps and conventional lead diving weights mounted thereon.

In use, the user grasps the substantially shank-type handgripping means and arranges the columnar-shaped, flexible buoyant member to partially encircle the user's body at the waist, between the legs, under the armpits, or behind the neck as elected so as to support the user while submerged and suspended in water. The user than performs the exercises of walking, jogging, cycling, cross-country skiing, or calisthenics, as elected. The user may also elect to attach the fluid reistance means to the handgripping means to provide added resistance to arm movements while exercising. Further, the user may elect to attach a series of weighted belts to the exercise device whereby the overall density of the exercise apparatus is increased, thus requiring greater efforts of the user to remain afloat while exercising. Further, the user may elect to attach a tether to the handgripping means or to the center of the flexible, buoyant support member and to another fixed object to hold the exerciser in place for stationary exercise.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a further understanding of the nature and objects of the invention, reference should be made to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
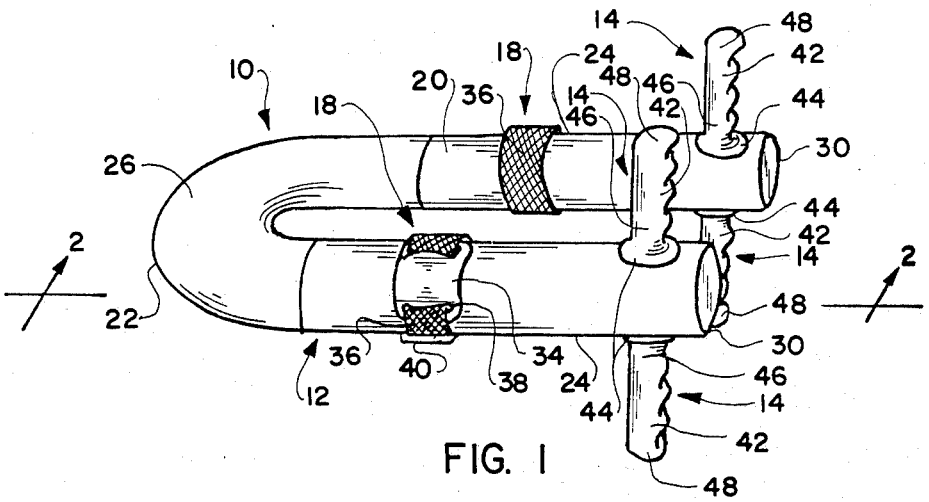
FIG. 1 is a perspective side view of the aquatic exercise device.
Figure 2:
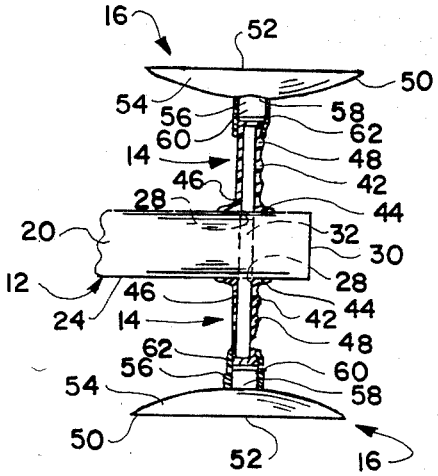
FIG. 2 is an enlarged longitudinal vertical sectional view of the handle members, the fluid resistance members and a fragmentary portion of an end section of the aquatic exercise device.
Figure 3:
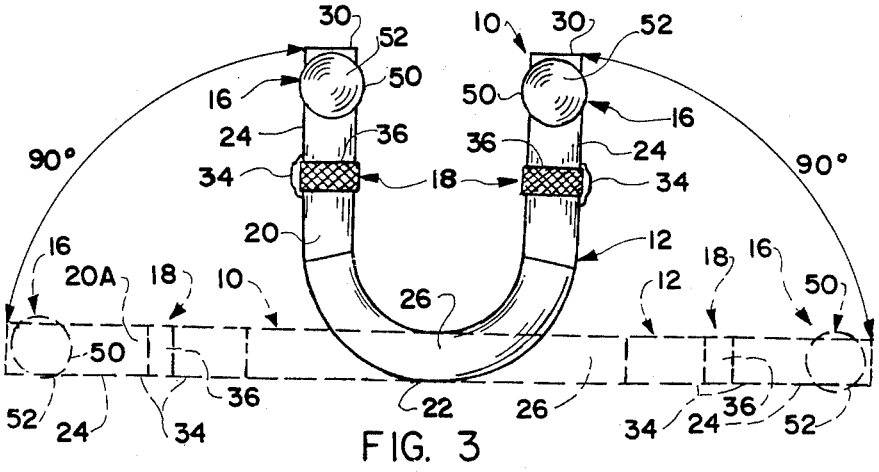
FIG. 3 is a top view of the aquatic exercise device with the fluid resistance means attached.

Referring now to the drawings in detail, as shown in FIGS. 1, 2, and 3, the present invention relates to an aquatic exercise device generally indicated as 10 for use in a swimming pool or the like. The aquatic exercise device 10 comprises a buoyant flexible support member generally indicated as 12, two pair of handle members each generally indicated as 14, and a fluid resistance means generally indicated as 16 and weighted belts generally indicated as 18.

The buoyant support member 12 comprises a substantially columnar-shaped flexible body 20 having a substantially C-shaped center 22 and a pair of substantially parallel outer members each indicated as 24. The substantially C-shaped center 22 is covered by a conventional, friction resistant, stretchable fabric material 16 along a length of approximately 20 inches. An aperture 28 is formed at a spaced distance from each terminal end, each indicated as 30, of the substantially parallel outer members 24 to receive a shank-type member 32. In the flexed position, FIGS. 1 and 3, the flexible body 20 forms a substantial U-shape. Alternately, the flexible body 20 may be elongated and extended outwardly and laterally 20*a* (phantom line of FIG. 3) over approximately 90. The buoyant support member 12 is preferably constructed of extruded, closed-cell, polyethylene foam. By use of this technology, the support member 12 possesses the desired characteristics of buoyancy, flexibility, and resiliency while maintaining the said U-shape with a uniform curvature at the center 22 while the outer members 24 maintain a substantially parallel relationship. The columnar-shaped flexible body 20 accepts detachably weighted belts 18. The belt 18 is preferably constructed of conventional webb-type strap material and is approximately 1 to 2 inches in width so as to have conventional lead diving weights 34 mounted thereon and secured in position on the belt 18 by means of surface friction between the skin 36 of the webb-type strap material of the belt 18 and the slit openings 38 in the lead weights 34. The weighted belts 18 are detachably secured to the columnar shaped body 20 by conventional buckles 40.

The handles members 14, best seen in FIGS. 1 and 2, comprise a pair of cylindrical rigid shank-type members 32 secured through the apertures 28 at a spaced distance from each terminal end 30 of the substantially parallel outer members 24. The shank-type members 32 extend entirely through the aperture 28 of the terminal end 30 of each substantially parallel outer member 24 forming a handle 14 above and below the terminal ends 30. Said handles 14 have conventional tubular handgrips 42 telescoped thereover. A flair 44 on the proximal end 46 of each said handgrip 42 secures the shank-type member 32 to the substantially parallel outer member 24.

The fluid resistance members 16, best viewed in FIG. 2, are provided to be detachably secured to the distal end 48 of each handgrip 42. Said resistance member 16 comprises a substantially circular rigid fluid resistance member 50 having a concave side 52 and a convex side 54 and a cylindrical rigid support shank 56 having proximal and distal ends 58 and 60. The proximal end 58 of said support shank 56 is secured to the convex side 54 of said fluid resistance member 50 and extends endwise outwardly and is generally disposed perpendicularly to the center of said circular fluid resistance member 50. Said cylindrical support shank 56 is approximately 2 to 4 inches long and 1 to 2 inches in diameter and the proximal end 58 is secured to the convex side 54 of the fluid resistance member 50 by welding and the distal end 60 is detachably secured to the distal ends 48 of the handgrips 42 by a length of conventional elastic tubing 62 telescoped thereover.

Figure 8:
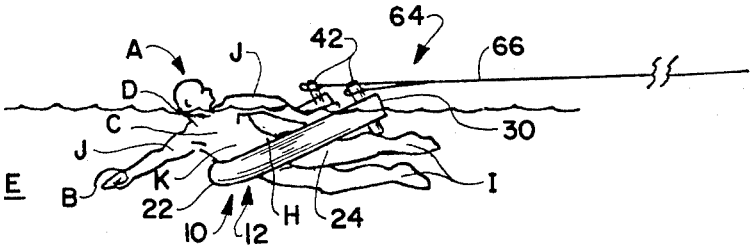
FIG. 8 is a perspective side view of a tethered swimming while using the aquatic exercise device.

A tether generally indicated as 64 comprising a nylon flexible rope 66 or the like, as illustrated at FIG. 8, may be detachably secured to the handgrips 42 or to the center 22 of the exercise apparatus 10 and to a fixed object such as a pool ladder or deck table.

Figure 4:
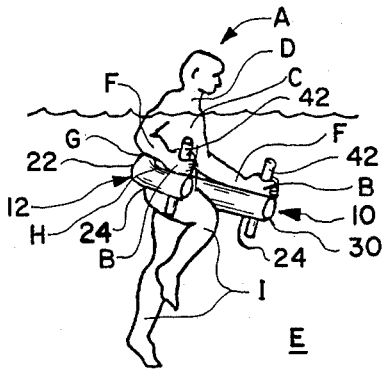
FIG. 4 is a perspective side view of an exerciser running in a body of water while using the aquatic exercise device.
Figure 5:
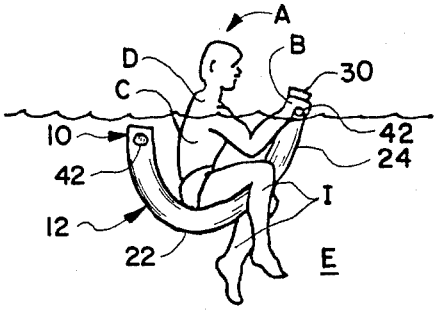
FIG. 5 is a perspective side view of an exerciser cycling in a body of water while using the aquatic exercise device.
Figure 6:
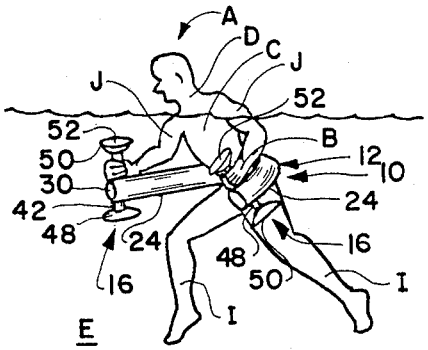
FIG. 6 is a perspective side view of an exerciser cross-country skiing in a body of water while using the aquatic exercise device.
Figure 7:
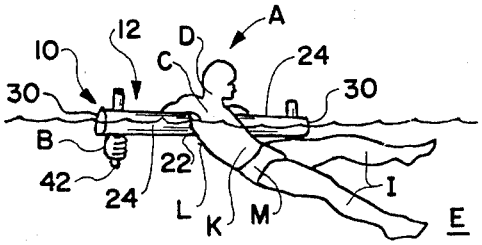
FIG. 7 is a perspective side view of an exerciser performing a calisthenic exercise while using the aquatic exercise device.

In use, the user A grasps the handgrips 42 with the hands B either above or below the proximal and distal ends 30 of the parallel outer members 24 as shown in FIGS. 4, 6, and 7, or on both sides of one end 30 of one parallel outer member 24 as shown in FIG. 5. The user then arranges the support member to partially encircle the body C and elects the perform the activities of running, cycling, cross-country skiing, stationary swimming, or various calisthenics while submerged to the neck D and suspended in water E as shown in FIGS. 4, 5, 6, 7 and 8. The weighted belts 18 are provided to be serially attached to the support member 12 to increase the overall density of the aquatic exercise device 10 when users with body densities significantly less than average cannot normally sink to the neck D level as previously described.

FIG. 4 illustrates running whereby the user A grasps the handgrips 42 with the hands B so that the forearms F rest on the outer members 24 of the support member 12. The user places the center 22 of the support member 12 into the lower portion of the back G and arranges the two outer members 24 on either side of the waist H to partially encircle the body C. The legs I of the user are then exercised and conditioned by running against the resistance of the water E itself. The specific construction and design of the support member 12 forming a "U"-shape, such that the open end of the "U" is in front of the user's waist H and the "closed" end of the "U" is at the user's back G, effectively tilts the user's body C slightly forward and into the natural running position. Moreover, this design allows the user to easily and quickly "cast off" the exercise apparatus 10 if desired.

FIG. 5 illustrates cycling whereby the user A sits astride the center 22 of the support member 12 and grasps the handgrips 42 as shown. The legs I of the user are then exercised and conditioned by "peddling" against the resistance of the water E itself.

FIG. 6 illustrates cross-country skiing whereby the user A assumes the same position within the exercise device 10 as described for FIG. 4. The legs I and arms J of the user are exercised and conditioned by performing cross-country skiing movements against the resistance of the water E itself. Water resistance to arm J movement is enhanced by attachment of the fluid resistance members 16 to the distal ends 48 of the handgrips 42. Thus it is observed that as the arms J are thrust forward and backward the concave sides 52 of the fluid resistance members 50 offer a significant resistance against the water E.

FIG. 7 illustrates the calisthenic exercise whereby the user A grasps the handgrips 42 with the hands B and places the center 22 of the support member 12 behind the upper back L and arranges the two outer members 24 to extend outwardly. The user then assumes a prone position and executes an array of calisthenic movements to exercise and condition the legs I, abdomen K and hips M against the resistance of the water E.

FIG. 8 illustrates stationary swimming whereby the user A places the center 22 of the support member 12 in front of the abdomen K and arranges the two outer members 24 to partially encircle the waist H. A tether 64 is attached to the handgrips 42 and to a fixed object located at pool-side The user then assumes a horizontal position and performs any of the conventional swimming strokes to exercise and condition the legs I and arms J by swimming against the resistance of the water E itself, while being held in a stationary position by the rope 66.

As can be observed, the specific combination of a flexible buoyant support body, the handles, the fluid resistance members and the weighted belts act in concert to provide means for running, cycling, cross-country skiing, stationary swimming and performing an array of calisthenics while submerged in a body of water up to the neck.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention which as a matter of language, might be said to fall therebetween. Now that the invention has been described.

What is claimed is:

1. An aquatic exercise device for use by an exerciser in a swimming pool or the like comprising:

a buoyant support member having a substantially elongated and columnar shaped flexible body defining a center member positioned between a pair of outer members;

each said outer member having a terminal end;

a pair of handgripping means with each handgripping means defining a substantially shank-type handgrip;

one of said substantially shank-type handgrip being positioned at each said terminal end of each said outer member, respectively;

each said substantially shank-type handgrips projecting endwise outwardly above and below a spaced distance from each said terminal end of each said outer member of said pair of outer members, respectively, to enable in use the exerciser to grip each said substantially shank-type handgrip to enable manipulation of said buoyant support member to partially encircle the body of the exerciser and to suspend the body of the exerciser in the pool and to enable movement by the exerciser suspended in the pool to be resisted by the water in the pool.

2. The aquatic exercise device of claim 1 wherein said substantially columnar-shaped elongated flexible body is sufficiently flexible to be manipulated in use by the exerciser to a substantially U-shaped configuration.

3. The aquatic exercise device of claim 1 wherein said shank-type handgripping means are substantially cylindrical.

4. The aquatic exercise device of claim 1 wherein each said substantially shank-type handgrips further includes a tubular handgrip telescoped thereover; and each said tubular handgrip includes a distal end and a proximal end.

5. The aquatic exercise device of claim 4 wherein each said outer member of said pair of outer members further includes an aperture formed in each said terminal end to enable each said outer member to securely receive said shank-type handgrip, respectively.

6. The aquatic exercise device of claim 5 wherein each said tubular handgrip includes a flair positioned at said proximal end of said tubular handgrip to anchor each said tubular handgrip in said aperture formed in each said terminal end of each said outer member.

7. The aquatic exercise device of claim 4 wherein each said tubular handgrip further includes a fluid resistance means detachably secured to each said distal end of each said tubular handgrip such that in use the resistance to movement of the exerciser suspended in the pool is increased.

8. The aquatic exercise device of claim 7 wherein each said fluid resistance means detachably secured to each said distal end of each said tubular handgrip comprises a substantially rigid, circular fluid resistance member having a substantially concave side and a substantially convex side with each said convex side of each said first and said second substantially rigid, circular fluid resistance members having a shank-type support means extending endwise outwardly, generally disposed perpendicularly to a center portion of each said convex side of each said fluid resistance member to enable detachable securement to each said distal end of each said tubular handgrips.

9. The aquatic exercise device of claim 1 further including a friction resistant, stretchable covering material covering said center portion of said flexible body to decrease in use frictional resistance upon engagement with the exerciser's body thereat.

10. The aquatic exercise device of claim 1 further including a weighted belt detachably secured to each said outer member, respectively, of said flexible body.

* * * * *